US005562512A

United States Patent [19]

Samelian

[11] Patent Number: 5,562,512

[45] Date of Patent: Oct. 8, 1996

[54] RESCUE DEVICE

[76] Inventor: John K. Samelian, 920 Rae Ct., Mendota Heights, Minn. 55118

[21] Appl. No.: 488,875

[22] Filed: Jun. 9, 1995

Related U.S. Application Data

[63] Continuation-in-part of Ser. No. 249,332, May 27, 1994, abandoned.

[51] Int. Cl.[6] ..... B63C 9/08

[52] U.S. Cl. ..... 441/81

[58] Field of Search ..... 441/80, 81, 84, 441/85; 446/34, 46, 48, 40, 42; 273/424; D21/85, 86; 244/34 A

[56] References Cited

U.S. PATENT DOCUMENTS

| | | | |
|---|---|---|---|
| 2,260,109 | 10/1941 | Amdal . | |
| 2,342,868 | 2/1944 | King . | |
| 3,378,865 | 4/1968 | Pigg . | |
| 3,520,008 | 7/1970 | Frieder et al. . | |
| 3,710,505 | 1/1973 | Linenfelser | 46/74 D |
| 3,974,536 | 8/1976 | Franklin | 441/85 |
| 4,059,859 | 11/1977 | Hull | 441/81 |
| 4,182,073 | 1/1980 | Tabet | 273/424 |
| 4,196,540 | 4/1980 | Hembree et al. | 273/424 |
| 4,416,640 | 11/1983 | Eickenhorst | 441/81 |
| 4,456,265 | 6/1984 | Adler | 273/425 |
| 4,560,358 | 12/1985 | Adler | 446/46 |
| 5,066,258 | 11/1991 | Tomberlin | 446/40 |
| 5,254,077 | 10/1993 | Nottingham et al. | 446/48 |

*Primary Examiner*—Sherman Basinger
*Attorney, Agent, or Firm*—Jacobson & Johnson

[57] ABSTRACT

A rescue device adapted to be thrown long distances through the air with the rescue device having a first asymmetrical-annular member having a cross sectional shape in the form of a airfoil with the outer peripheral edge forming a trailing edge of the airfoil and the inner peripheral edge forming a leading edge of the airfoil and a second asymmetrical-annular member having a cross sectional shape in the of a second airfoil with the outer peripheral edge of the second member forming a trailing edge of the airfoil and the inner peripheral edge of the second annular member forming a leading edge of the airfoil with the two members coacting to allow the rescue device to be thrown accurately over long distances with the rescue device including a set of spacers to hold the first asymmetrical-annular member and the second asymmetrical-annular in a spaced apart parallel relationship to allow a line located between the asymmetrical-annular members to unwind therefrom as the rescue device is thrown to a person in distress.

14 Claims, 3 Drawing Sheets

RESCUE DEVICE

CROSS REFERENCE TO RELATED APPLICATIONS

This applications is a continuation-in-part of my corresponding to U.S. patent application Ser. No. 08/249,332 filed May 27, 1994 titled Rescue Device (now abandoned).

FIELD OF THE INVENTION

This invention relates generally to rescue devices and more specifically to improvements to rescue devices that allow the rescue devices to fly farther and more accurately than prior art rescue devices.

BACKGROUND OF THE INVENTION

Although the concept of throwing rescue rings or rescue devices to people in distress who are located in inaccessible areas is known in the art, one of the difficulties has been to accurately throw the rescue device for distances exceeding 50 feet. The present invention involves a discovery that the use of two spaced-apart annular members each having an asymmetrical airfoil shape with a trailing edge of the airfoil located on the outer portion of the rings for slicing through the air and a leading edge of the airfoil located located in the inner portion of the ring provides surfaces on the rescue ring that aerodynamically coact with each to other to allows the rescue ring to be thrown accurately for distances in excess of 100 feet.

BRIEF DESCRIPTION OF THE PRIOR ART

U.S. Pat. No. 2,342,868 shows a rescue ring having a rope coiled around a flotation cushion. When the rescue ring is tossed, the thrower gives the rescue ring a spinning motion allowing for the rope unwind from the cushion.

U.S. Pat. No. 3,520,008 shows a method of making a reinforced, expanded, synthetic resin buoyant life ring having a generally elliptical cross-section.

U.S. Pat. No. 3,710,505 shows an aerodynamic toy made of a polyurethane toy having a generally flat top surface with rounded edges to produce aerodynamic lift.

U.S. Pat. No. 3,560,358 shows a single gliding ring having a cross section with an airfoil shape.

U.S. Pat. No. 4,182,073 shows a twin flying saucer toy having two disk shaped members secured to each other by spacers.

U.S. Pat. No. 4,456,265 shows a single gliding ring having a cross section with an airfoil shape and an angled lower surface on the airfoil.

U.S. Pat. No. 3,974,536 shows a life-saving device which includes a water floatable member which is sized to be held conveniently in the hand and having sufficient weight to permit it to be thrown a considerable distance.

U.S. Pat. No. 4,059,859 shows a life-saving ring having a foam-plastic center region with a secondary ring attached to the exterior of the rescue device. The cross-section area of the rescue device has a triangular appearance.

U.S. Pat. No. 4,196,540 shows an aerodynamic toy having a flat surface with a concave inner surface and made from a flexible foam material.

U.S. Pat. No. 4,416,640 shows a life ring which has releasably attaching members for holding a rescue line thereto to permit the unrolling of the rescue line from the life ring.

U.S. Pat. No. 5,066,258 shows a return flying toy much like a yo-yo which when thrown will return to the user.

U.S. Pat. No. 5,254,077 shows a tethered flying toy in which a line is attached to the center of the toy.

U.S. Pat. No. 2,260, 109 shows a rescue device in which allows the coil to be the line to be pulled off the coil from the inward section of the coil.

Canadian patent 1,225,545 shows a heavy line storage and deployment apparatus having two symmetrical disks which are spaced apart with a central drum for holding a coil of rope. The apparatus can be thrown to a person overboard. As the device is thrown, the rope unwinds. The inventor describes the disk as providing aerodynamic surfaces capable of providing lift and states the surfaces lose there aerodynamic qualities if the convexity of the disks are too great. He states his device can be thrown for distances up to 50 feet. However, the device lacks airfoil lifting capabilities as the shape is symmetrical and cannot generate pressure differential forces across his device. In addition the device has a leading edge which is flat and ploughs through the air rather than slices through the air.

SUMMARY OF THE INVENTION

The invention comprising a rescue device that rotates about a central axis as it is thrown to a person in distress. The rescue device has a first asymmetrical-annular member having a cross sectional shape in the form of an airfoil with the outer peripheral edge of the annular-member forming a trailing edge of the airfoil for slicing through the air. In another embodiment the inner peripheral edge of the annular-member forms a leading edge to the airfoil and a second asymmetrical-annular member having a cross sectional shape in the form of a second airfoil with the outer peripheral edge of the second member forming a trailing edge of the airfoil and the inner peripheral edge of the second annular member forming a leading edge of the airfoil. A set of spacers hold the first asymmetrical-annular member and the second asymmetrical-annular in a spaced apart parallel relationship to allow a rescue rope located between the asymmetrical-annular members to unwind therefrom as the rescue device is thrown to a person in distress. In another embodiment the line retaining device is located the maximum diameter of the rescue device.

DESCRIPTION OF THE PREFERRED EMBODIMENT

Figure 1:
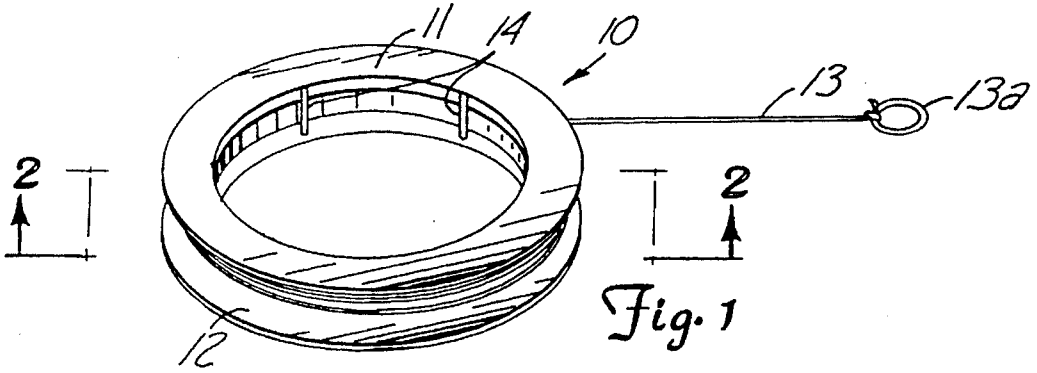
FIG. 1 shows a perspective view of a rescue ring for land rescues.
Figure 2:
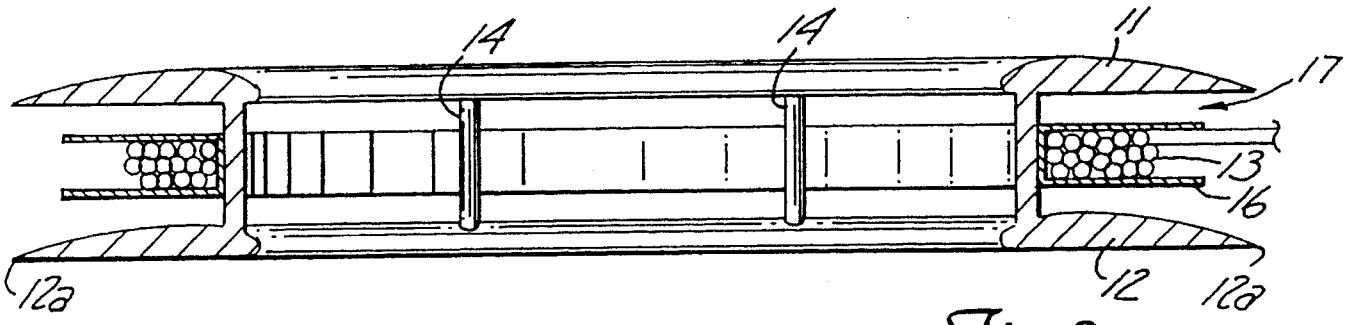
FIG. 2 shows a cross-section taken along lines 2—2 of FIG. 1.

Referring to FIG. 1 and FIG. 2, reference numeral 10 generally identifies my long fly rescue device or rescue ring comprising a first asymmetrical-annular member 11 and a second, concentrically positioned asymmetrical-annular member 12 having spacers 14 extending perpendicularly to the two members to hold the two members in a spaced-apart relationship. A cord 13 is shown located in and annular cord retainer 16. The cord retainer 16 is secured to spacers 14 and located in a U-shaped cavity 17 formed between top member 11 and bottom member 12. Annular cord retainer 16 mounts to spacers 14 and is positioned centrally in cavity 17. Annular cord retainer 16 has a U-shaped cross section. In the embodiment shown, cord retainer 16 confines a cord or line 13 completely within retainer 16. The drawing shows a space between the two asymmetrical-annular members 11 and 12 and cord retainer 16 to allow air to flow around the two cord retaining member 16 and between members 11 and 12.

Figure 3:
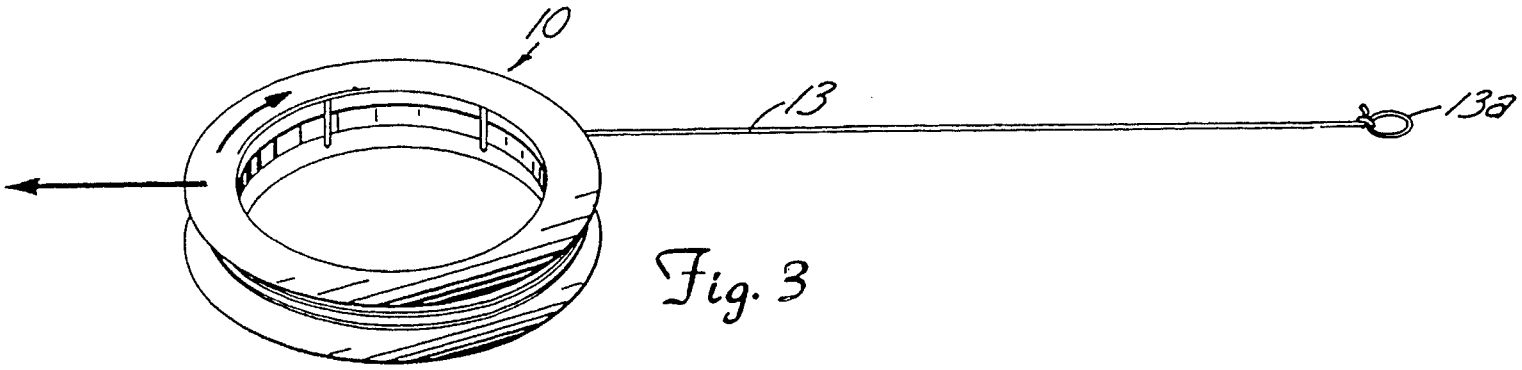
FIG. 3 shows the relative direction and rotation of the rescue ring of FIG. 1 after it is thrown.

FIG. 3 illustrates that as rescue device 10 glides through the air it simultaneously moves forward and rotates allowing line 13 to unwind from the rescue device.

Figure 6:
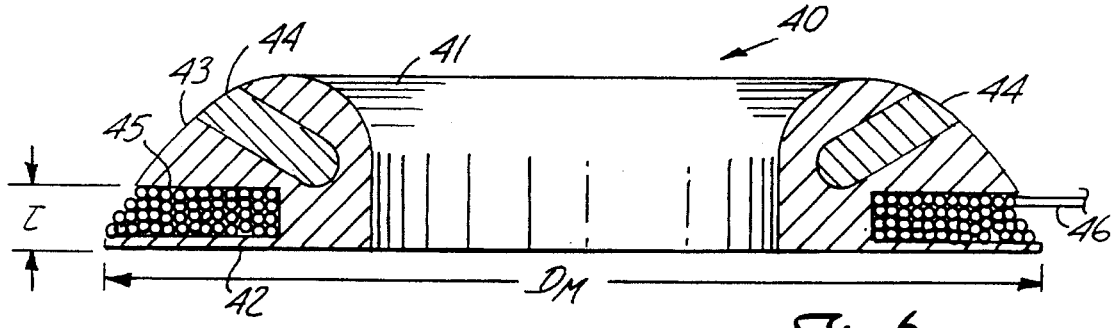
FIG. 6 shows a rescue ring formed from a flotation material with finger holes in the rescue ring.

In order to understand the relationship of the various surfaces on the rescue ring that coact to produce lift reference should be made to FIG. 6. FIG. 6 shows an enlarged cross sectional view of the asymmetrical-annular member 12 having a general airfoil shape. By airfoil shape it is meant that the shape is streamlined so that under normal throwing conditions air can flow smoothly around the airfoil. The purpose of having an asymmetrical-annular member is to provide member 12 with lift as it is flies through the air. A dashed line 18 and a dashed line 19 generally define a central region of asymmetrical-member 12 with the region to the left of dashed line 18 defined as a trailing edge and the region to the fight of dashed line 19 defined as a leading edge. Located below annular member 12 is a semi-concave or flat surface **12*d* and located above annular member 12 is a convex surface 12*c*** to provide an asymmetrical airfoil shape that provides lift. It is well known that an asymmetrical airfoil will provide lift but it was not known that when two asymmetrical-annular member each having an airfoil shape are stacked on top of one another one can produce a rescue device that can fly farther and more accurately than prior art rescue devices.

FIG. 2 also illustrates that airfoil trailing edge **12*a* is located radially outward on rescue device 10 and the normal leading edge of airfoil 12*b* is located radially inward on rescue device 10. In addition, the positions of the airfoils are such that they are stacked directly on top of another with the upper convex surface on member 11 and the upper convex surface 12*c* on member 12 both located on the top side of rescue device 10**. The aerodynamic operation of the invention is not fully understood, however, the use of two asymmetrical-annular members positioned in a spaced apart relationship and carrying a line therebetween have been found to be more effective than if the rescue ring contains symmetrical surfaces. It has been found that with the present invention one can throw the rescue device in a relative straight line making it easier to throw the rescue device to a person in distress. That is, the rescue device does not sail or follow a curved arc like a frisbee or a boomerang.

Tests with the device show that the device of FIG. 1 can be thrown accurately for distances well in excess of 100 feet. Even if the lightweight cord is not strong enough to rescue a person, the capacity of being able to throw the rescue device over greater distances allows one to throw the rescue device with a lightweight line to a person and than attach a stronger line to the end of the lightweight line and let the person in distress or a second rescuer pull the stronger line to himself or herself with the lightweight line.

Figure 4:
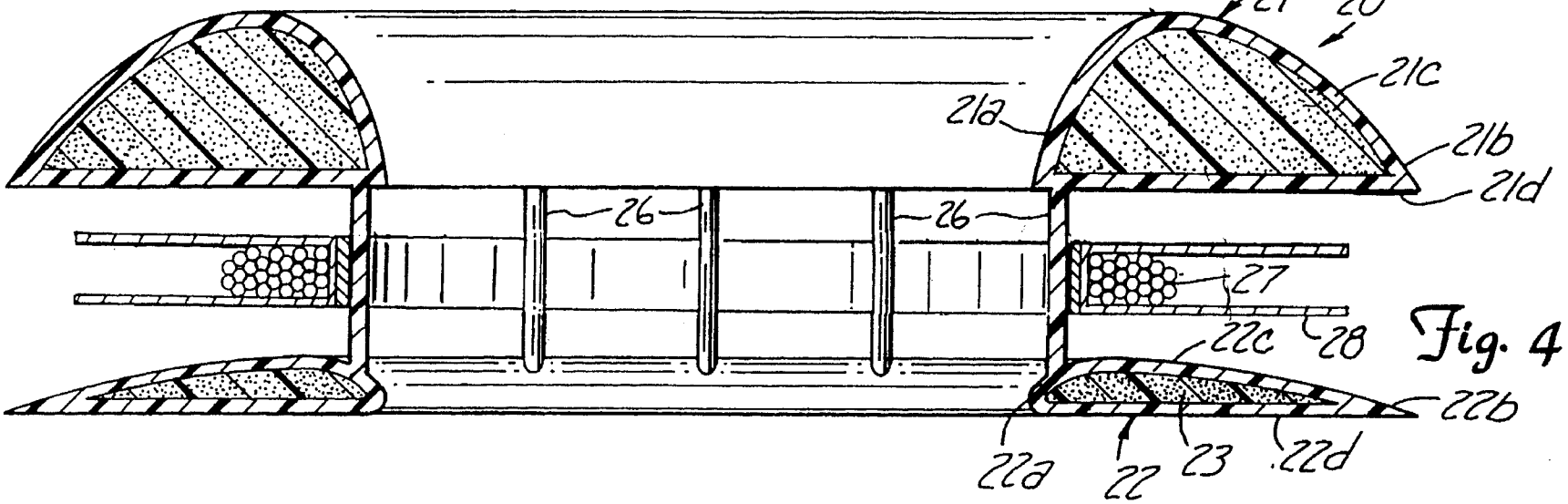
FIG. 4 shows a cross-sectional view of an alternate embodiment of a rescue ring for use in either land or water rescues.

FIG. 4 shows an alternate embodiment of a rescue device 30 which is suitable for water rescue. Rescue device 30 is similar to the rescue device of FIG. 1 in that two asymmetrical-annular members are stacked on top of each other with spacers 26 holding the two asymmetrical members in a spaced apart relationship. The rescue device 30 of FIG. 4 differs form the rescue device 10 in that while both the upper asymmetrical-annular member 21 and the lower asymmetrical-annular member 22 are asymmetrical the upper asymmetrical-annular member has a different asymmetrical shape from the lower asymmetrical-annular member 22. The lower asymmetrical-annular member 22 has an airfoil shape having an inner flotation member 23 surrounded by an outer plastic layer **22*c*. The flotation member 23 ensures that the rope on the rescue ring and the ring will float if they are thrown to someone in the water. Flotation member 23 has sufficient buoyancy to support a person in the water. Asymmetrical-annular member 22 contains a leading edge 22*a*. and a trailing edge 22*b* which is located on the outer peripheral portion of the rescue device. The lower surface 22 and the top surface 22*c* provide asymmetrical surfaces to provide lift. A set of spacers 26 connects the lower ring 22 to the upper ring 21. The upper asymmetrical-annular member 21 has an airfoil shape having an inner flotation member 24 surrounded by an outer plastic layer 21*c*. Asymmetrical-annular member 21 contains a leading edge 21*a* and a trailing edge 21*b* which is located on the outer peripheral portion of the rescue device. The lower surface 21*d* and the top surface of asymmetrical-annular member coact to provide lift. Upper ring 21 is substantially larger with a larger flotation member 24**.

Figure 5:
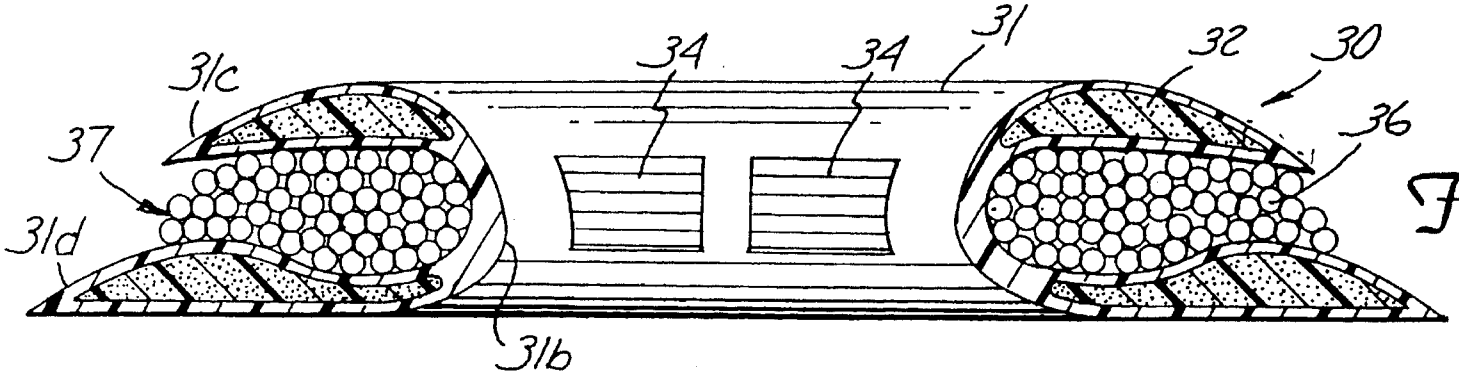
FIG. 5 shows a further alternate embodiment of a rescue ring for use in either land or water rescues.

FIG. 5 shows a further alternate embodiment 30 of the invention which I refer to as my short throw version which is suitable or throwing shorter distances ranging typically ranging from 10 to 100 feet. Rescue ring 30 can be used for rescue purposes but is also well suited for such tasks as docking a boat where the ring is tossed from a boat to a person on the dock. When the rescue ring is made of soft material ring 30 can be comfortably caught in a persons hand. Rescue ring 30 contains an outer single continuous shell 31 having a top annular flotation member 32 located in the top portion of rescue ring 30 and a similar annular flotation member 33 located in the bottom portion of rescue ring 30. A set of openings 34 extend through member 30 allow airflow through the rescue ring as rope 36 unwinds from an integral cord retainer formed by annular U-shaped cavity 37. The rescue device shown in FIG. 5 is characterized in that there is a single, continuous surface **31*b* forming a normal leading edge and two separate trailing edges 31*c* and 31*d* which are located in concentric position with the one trailing edge located radially inward of the other. The single continuous member makes the device comfortable to catch in one's hand. With the device of FIG. 5 during the first portion of the throw the rope unwinds until the openings 34 are uncovered which allows for airflow through the rescue ring 30. While the rescue ring 30 can be accurately thrown without openings 34 uncovered openings 34 allows for air to flow through the device, however, ring 30 can be used effectively without openings 34. The embodiment of FIG. 5 is suitable shorter distances of less than 50 feet as well as distance in excess of 50 feet with the distance the device can be thrown generally being determined by the weight of the rope. Ring 30** is preferable made from lightweight materials such as polymer plastics or rubber. In order to provide comfort in catching the device a soft resilient polymer plastic is preferred.

TEST RESULTS

A double wing rescue ring as illustrated in FIG. 2 was wound with a 2 mm diameter cord. The rescue ring was repeatedly thrown with one hand to measure both the accuracy and the distance flown by the rescue ring. While the distance the double wing rescue ring can be thrown depends on the arm strength of the person throwing the rescue ring, it was found that a middle age adult male standing on a level field could consistency throw the rescue ring a distance of 130 feet. To determine accuracy, targets were set up less than 100 feet from the person. The double wing rescue ring could be thrown to within a 3 foot radius of the targets about 90% of the time.

A flotation rescue ring as shown in FIG. 5 was wound with ¼ inch diameter nylon rope. The radial openings in the rescue ring were covered. When the rescue ring was thrown on a flat field by and adult male the rescue ring consistency flew distances up to 100 feet. The flight of the rescue ring was a generally straight path toward the target and the rescue ring did not sail to the left or tight as the rescue ring approached the target.

For comparison purposes a rescue device was made with symmetrical upper and lower surfaces and with a closed center. An ⅛ inch nylon cord was wrapped around a recess in the rescue device. The rescue device could be thrown an average of 58 feet. The device would flutter and appeared to lack any appreciable flying effect. The rescue device was then modified to have an open center and asymmetrical airfoil surfaces rather than symmetrical surfaces so that the rescue device appeared as the rescue ring of FIG. 2. The modified rescue ring with the asymmetrical surfaces and open center flew an average of 85 feet or approximately 46% farther than the rescue device with the symmetrical surfaces and the closed center.

While the rescue ring of my invention can be thrown accurately over long distances it should be pointed out that a number of factors or characteristics of the rescue ring can effect the distance the rescue ring flies. Typical factors that effect the distance that the rescue ring flies are the empty weight of the rescue ring, the circumference of the rescue ring, the width of the airfoil, the separation of the airfoils, the weight of the rope, the relative asymmetry of the airfoils and the relative size of the upper and lower airfoils. Other external factors not related to the characteristics of the rescue ring that can effect the distance the rescue rings flies are the strength of the thrower, the wind, and the elevation. For example, if the rescue ring is thrown over a flat field it will not fly as far as if it is thrown down a hill. Also a rescue ring thrown into the wind will not fly as far as one that is thrown with the wind.

Referring to FIG. 6 there is shown rescue ring 40 formed from a flotation material 41 and having sufficient buoyancy so as to support a person in the water. Rescue ring 41 has an asymmetrical shape formed by the lower surface 42 and upper surface 43. The asymmetrical shape causes the air to flow faster along surface 43 than surface 42 thereby producing lift. Located in a spaced relation around ring 40 are finger holes 44. The purpose of finger holes 44 is to provide hand grips for the user to grasp the rescue ring without having to extend his or her hand around the entire rescue ring. The rescue ring 40 has a maximum diameter designated by $D_m$. Located next to the maximum diameter region is an annular lip compartment 45 containing a rope 46. Rope 46 is wound around the rescue ring and fills compartment 45. The compartment extends a distance t upward which is preferably less than ⅓ the thickness of the flotation device to minimize interference with the airflow over the surface. In embodiment 40 the line compartment 45 is located at the maximum diameter of the rescue ring. It has been found that by placing the line compartment in the maximum diameter section of the rescue ring it allows the line to unroll freely from the rescue ring. If the line compartment is on a portion of the rescue ring of smaller diameter it becomes difficult for an individual to impart sufficient rotation to the rescue ring to enable the line to unfurl freely. In addition having the rope in the maximum diameter portion of the rescue ring increases the likelihood that the thrower can consistently deliver the rescue ring to a specific location. That is, by minimizing the effect of the line pull on the rescue device it provides a more stable rotation of the rescue ring.

Figure 7:
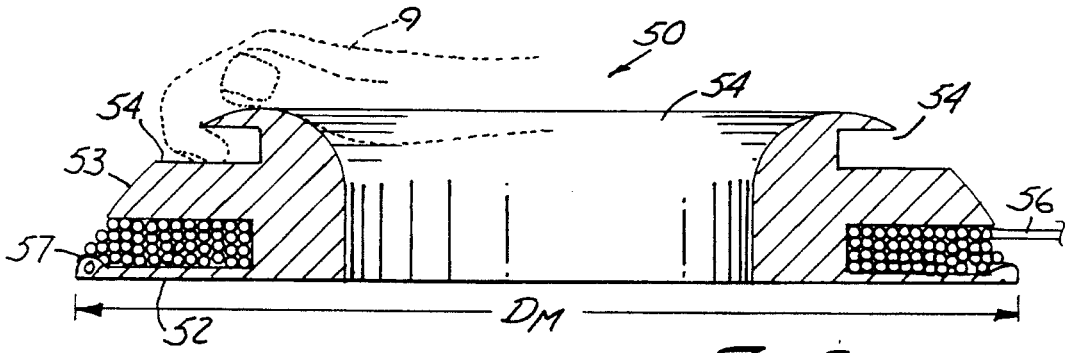
FIG. 7 shows an alternate embodiment of the rescue ring of FIG. 6.

FIG. 7 shows an alternate embodiment 50 having an annular floatation material 51 with a lower surface 52 and an upper curved surface 53 for directing air around the rescue ring. Rescue ring 50 includes an annular recess 54 which allows a person being rescued to hold onto the ring without interfering with the rope being unwound from the rescue ring. In addition embodiment 50 includes a soft annular lip 57 that extends around rescue ring 50 to provide cushioning as one catches the rescue ring. The purpose of soft annular lip is to make the rescue ring easier to catch by providing a cushion.

Figure 8:
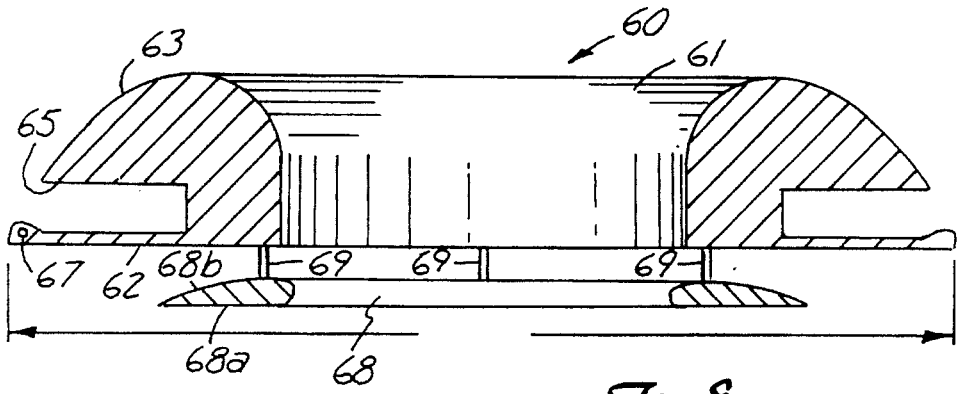
FIG. 8 shows a further embodiment of the rescue ring of FIG. 6.

FIG. 8 shows a further embodiment 60 having a smaller secondary air foil 68 which is spaced from rescue ring surface 62 by spacers 69. That is the flow of air around air foil 68 is such that the surface **68*a* is substantially straight while surface 68*b* is substantial curved which forces the air to flow faster around surface 68*b* than 68*a* thereby resulting in lower pressure on surface 68*b* than 68*a*. The use of a second air foil tends to provide more stability and thus enable a user to throw the rescue ring more accurately. A rectangular shaped line compartment 65 extends around rescue ring 61 with an annular cushion lip 67** located thereon to provide a cushion to the person catching the rescue ring.

As can be seen in FIGS. 6–8 the embodiments all include leading edges with no dead space. That is, the asymmetrical members 41, 51 and 53 each have front surfaces that form a wedge like appearance for slicing through the air rather than a flat forward surface that ploughs through the air.

While the embodiments have been shown with a lip channel for holding a rope, in certain applications one may want to throw the unit without a rope in order to get the flotation device to a person or persons.

I claim:

1. A life saving device for rescuing a person with the life saving device adapted to be thrown through the air so as to rotate about a central axis with the life saving device having:

a first annular member having an outer peripheral edge and an inner peripheral edge, said first annular member having a cross sectional shape in the form of a first airfoil with the outer peripheral edge forming the trailing edge of the airfoil and the inner peripheral edge forming the leading edge of the airfoil to thereby provide lift to the first annular member, said leading edge having a wedge like shape to facilitate slicing through the air;

a second annular member having an outer peripheral edge and an inner peripheral edge, said second annular member having a cross sectional shape in the form of a second airfoil with the outer peripheral edge of the second annular member forming a trailing edge of the airfoil and the inner peripheral edge of the second annular member forming a leading edge of the airfoil to thereby provide lift to the second annular member; and spacers connecting said first annular member and said second member in a spaced apart parallel relationship so that said first annular member and said second annular member rotate as a unit to allow the life saving device to be thrown accurately.

2. The life saving device of claim 1 wherein said spacers includes a cord retainer for holding a rescue line in a coiled position therein to permit the rope to uncoil from said life saving device as the life saving device flies through the air.

3. The life saving device of claim 2 wherein the cord retainer is central located between said annular members to permit air to flow between said annular members and around said cord retainer.

4. The life saving device of claim 1 wherein the spacers connect the inner peripheral edge of said first annular member to the inner peripheral edge of said second annular member.

5. The life saving device of claim 1 including openings in the life saving device to permit air to flow through the life saving device.

6. The life saving device of claim 1 wherein the first annular member and said second annular member are made of buoyant material to permit said life saving device to float on water.

7. A life saving device for rescuing a person with the life saving device adapted to be thrown through the air so as to rotate about a central axis with the life saving device having:

a first asymmetrical-annular member having a first diameter with a first cross sectional shape in the form of a first airfoil to thereby provide lifting surfaces to the first asymmetrical-annular member;

a second asymmetrical-annular member having a cross sectional shape in the form of a second airfoil of a different cross sectional shape to thereby provide lifting surfaces to the second asymmetrical-annular member, said second asymmetrical-annular member having a diameter larger than said first diameter;

spacers connecting said first asymmetrical-annular member and said second asymmetrical-annular member in a spaced apart relationship; and a line connected to a peripheral region of said life saving device so that when said life saving device is thrown said line remains attached to the life saving device as the life saving device glides through the air.

8. A life saving device adapted to be thrown through the air so as to rotate about a central axis with the life saving device having:

an asymmetrical-annular member having a pointed annular edge with the asymmetrical-annular member having a cross sectional shape in the form of a first airfoil to thereby provide lifting surfaces to the asymmetrical-annular member, said asymmetrical-annular member having a first annular exterior surface and a second annular exterior surface with said first annular exterior surface defining one portion of the asymmetrical-annular member and said second annular exterior surface defining the second portion of the asymmetrical-annular member to allow air to flow across both of said exterior surfaces, said asymmetrical-annular member having a maximum diameter proximate the pointed annular edge of said member;

a lip channel cord retainer therein, said cord retainer located proximate the leading edge so that a line stored in said cord retainer unwinds from said lip channel; and a line connected to and stored in a coiled fashion on said life saving device so that when said life saving device is thrown said line unwinds from the life saving device but remains attached to the life saving device as the life saving device glides through the air to thereby enable a person throwing the life saving device to pull a person in peril to safety.

9. A life saving device adapted to be thrown through the air so as to rotate about a central axis with the life saving device having:

an asymmetrical-annular member having a pointed annular edge with the asymmetrical-annular member having cross sectional shape in the form of a first airfoil to thereby provide lifting surfaces to the asymmetrical-annular member, said asymmetrical-annular member having a maximum diameter proximate the pointed annular edge of said member: with said asymmetrical member including thumb holes to enable a user to grasp said asymmetrical-annular member in one hand;

a lip channel cord retainer therein, said cord retainer located proximate the leading edge so that a line stored in said cord retainer unwinds from said lip channel; and a line connected to and stored in a coiled fashion on said life saving device so that when said life saving device is thrown said line unwinds from the life saving device but remains attached to the life saving device as the life saving device glides through the air to thereby enable a person throwing the life saving device to pull a person in peril to safety.

10. The life saving device of claim 8 including an annular finger ring in said asymmetrical-annular member to enable a user to gasp said asymmetrical-annular member in one hand.

11. The life saving device of claim 8 including a stabilizer airfoil connected to said life saving device to provide stability to said life saving device as said life saving device is thrown through the air.

12. The life saving device of claim 8 wherein the life saving device is made of a water floatable material and has sufficient buoyancy to hold a person above water.

13. The life saving device of of claim 12 wherein the lip channel has a rectangular cross section.

14. The life saving device of of claim 13 wherein the lip channel has a width that extends less than ⅓ of the thickness of the life saving member.

* * * * *